United States Patent [19]

Planeta

[11] Patent Number: 4,748,884

[45] Date of Patent: Jun. 7, 1988

[54] CUTTING ASSEMBLY FOR CUTTING THIN STRIPS OF FLEXIBLE MATERIAL

[76] Inventor: Mirek Planeta, 228 McCraney St. W., Oakville, Ontario, Canada, L6H 1H7

[21] Appl. No.: 16,813

[22] Filed: Feb. 20, 1987

[51] Int. Cl.[4] ..... B65H 19/26

[52] U.S. Cl. ..... 83/554; 83/611; 242/56 A

[58] Field of Search ..... 83/554, 556, 610, 611; 242/56 A

[56] References Cited

U.S. PATENT DOCUMENTS

| | | | |
|---|---|---|---|
| 4,189,966 | 2/1980 | Keigley | 83/554 X |
| 4,214,357 | 7/1980 | Delves | 83/554 X |
| 4,326,679 | 4/1982 | Phelps et al. | 242/56 A |
| 4,484,714 | 11/1984 | Puzey | 242/56 A |
| 4,541,583 | 9/1985 | Forman et al. | 242/56 A |

*Primary Examiner*—Frank T. Yost

*Attorney, Agent, or Firm*—Rogers & Scott

[57] ABSTRACT

The invention provides a cutting assembly for cutting a moving strip of thin flexible material across its width, avoiding the possibility that the flexibility of the material will permit it to move away from the knife edge and not be cut, or be cut unevenly. The assembly comprises a knife-supporting member which is engaged with the moving strip and displaces it out of its usual path close to a roll in the path, so that a very short length of the strip is between two contacting members in the path adjacent to the knife. The knife is provided along its length with a plurality of distributed strip-engaging points pointing in the direction opposite to its direction of movement, which are moved into engagement with this short supported length of the strip, so that the strip movement drives it onto the points, and thereafter continues the movement of the strip into positive engagement with the succeeding knife edges. The assembly is particularly suited for the handling of flattened tubes of plastic material as produced by a blown film plastics line, wherein the continuous strip must be cut for subsequent handling and/or storage.

8 Claims, 5 Drawing Sheets

CUTTING ASSEMBLY FOR CUTTING THIN STRIPS OF FLEXIBLE MATERIAL

FIELD OF THE INVENTION

The present invention is concerned with improvements in or relating to cutting assemblies for cutting thin strips of flexible material, particularly for cutting thin continuous strips of flexible plastics material during their production and handling in a continuous industrial process.

REVIEW OF THE PRIOR ART

A typical example of a continuous industrial process producing thin continuous strips of flexible plastics material is a blown film production line, wherein molten plastics material is extruded from an annular die orifice in the form of a tube. Air under pressure is fed to the interior of the tube to expand it and reduce correspondingly the thickness of the wall; when the material has cooled sufficiently the tube is flattened, slit longitudinally if required, and rolled into storage rolls to await subsequent processing into bags, etc. It is important for economical operation that all steps of the process are continuous, and consequently it is necessary to be able to cut the thin flexible tube transversely while it is moving, as each storage roll reaches a predetermined maximum size. This is done by means of a cutting assembly provided alongside the path of the moving web and operable to engage the web and cut it, either automatically in response to sensing that the storage roll is of sufficient size, or by action of the operator. Owing to the flexibility of the strip, difficulty has been experienced with prior art cutting assemblies in ensuring that the strip does not move away from the knife, especially when the strip is relatively thick and rubbery, which may then fail to cut and cause consequent problems in the process. One kind of prior art knife that avoids this problem is a draw knife, consisting of a sharp deep blade mounted on a support that is moved quickly across the width of the strip. However, these knives are found in practice to be quite dangerous, and in that they can cause very serious injuries, careful safety systems must be included.

DEFINITION OF THE INVENTION

It is therefore the principal object of the invention to provide a new cutting assembly for cutting thin moving strips of flexible material.

It is a more specific object to provide such an assembly having a cutting knife that is positively engaged with a thin flexible moving strip of material to be cut, such positive engagement being increased by the movement of the strip so as to facilitate the cutting action of the knife.

It is also an object to provide a cutting assembly that inherently is relatively safe in its operation.

In accordance with the present invention there is provided a cutting assembly for strip-handling apparatus in which a thin, flexible strip of material to be cut by the assembly moves in a strip path of the apparatus in a corresponding direction of movement, comprising:

an apparatus frame;

an elongated knife blade of length at least the width of the strip and having distributed along its length a plurality of strip engaging and piercing knife points in advance of succeeding strip severing knife edges;

knife mounting means mounting the knife blade to extend transversely of the strip direction of movement with the said knife points pointing in the direction opposite to the direction of movement of the strip, and also for movement of the knife blade between an inoperative attitude in which the knife points and edges are clear of the strip and an operative attitude in which the knife points and edges engage the strip;

support means mounting the knife mounting means in the apparatus frame for movement between an inoperative position in which the knife mounting means and the knife are clear of the strip, and an operative position in which the knife mounting means is adjacent to a portion of the strip, without engagement of the knife points and edges with the strip;

motor means connected between the apparatus frame and the support means and operative to move the support means for said movement between the inoperative and operative positions; and motor means mounted between the support means and the knife mounting means and operative to move the blade between the said inoperative and operative attitudes, in the operative attitude the knife points engaging the adjacent portion of the strip, whereby the movement of the strip positively engages the strip with the knife points and thereafter with the knife edges to sever the strip across its width.

Preferably in the said operative position the support means engages the strip, particularly the knife mounting means thereof, to displace the said adjacent portion of the strip from its path.

DESCRIPTION OF THE DRAWINGS

A cutting assembly that is a particular preferred embodiment of the invention will now be described, by way of example, with reference to the accompanying diagrammatic drawings, wherein.

DESCRIPTION OF THE PREFERRED EMBODIMENT

Figure 1:
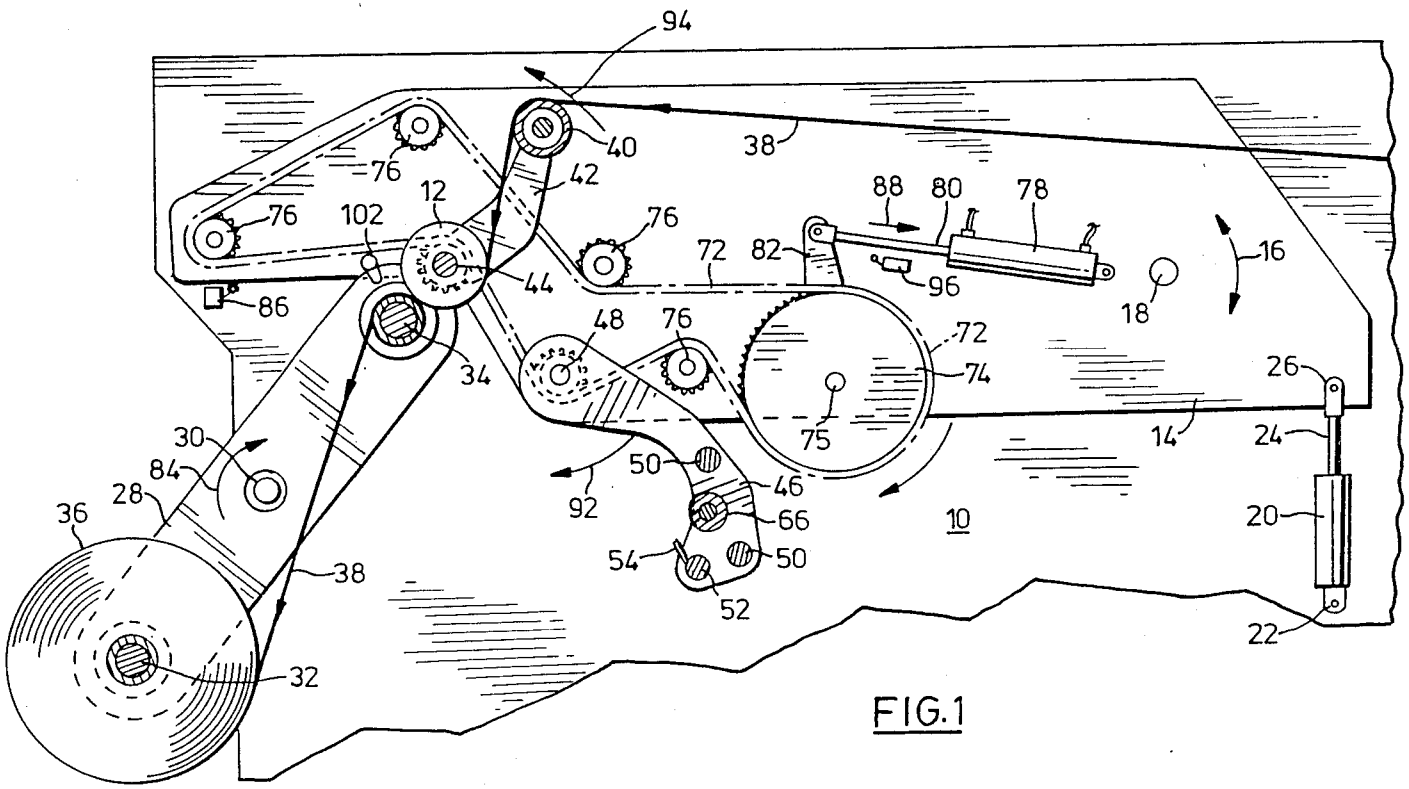
FIG. 1 is a side elevational view of part of a turret winder for thin flexible film and showing the cutting assembly in stored inoperarive position.

The various elements of the cutting assembly and turret winder that are illustrated are mounted on a main support structure, comprising two thick, rigid, transversely-spaced, parallel metal side members 10 (only one shown) connected rigidly together by suitable cross-members (not shown) and with the said various elements mounted between them. The details of such a support structure are not essential to an understanding of this invention and will be apparent to those skilled in the art of such mechanical constructions.

An apparatus frame which supports the cutting assembly and also a lay-on roller 12 consists of two parallel side members 14 (only one shown) connected together by cross-members (not shown) and mounted for pivoting movement in the direction of arrows 16 about a transverse pivot member 18. This movement is produced when required by a pneumatic motor 20 connected at 22 to the side member 10 and having its piston 24 connected at 26 to the side member 14.

Figure 2:
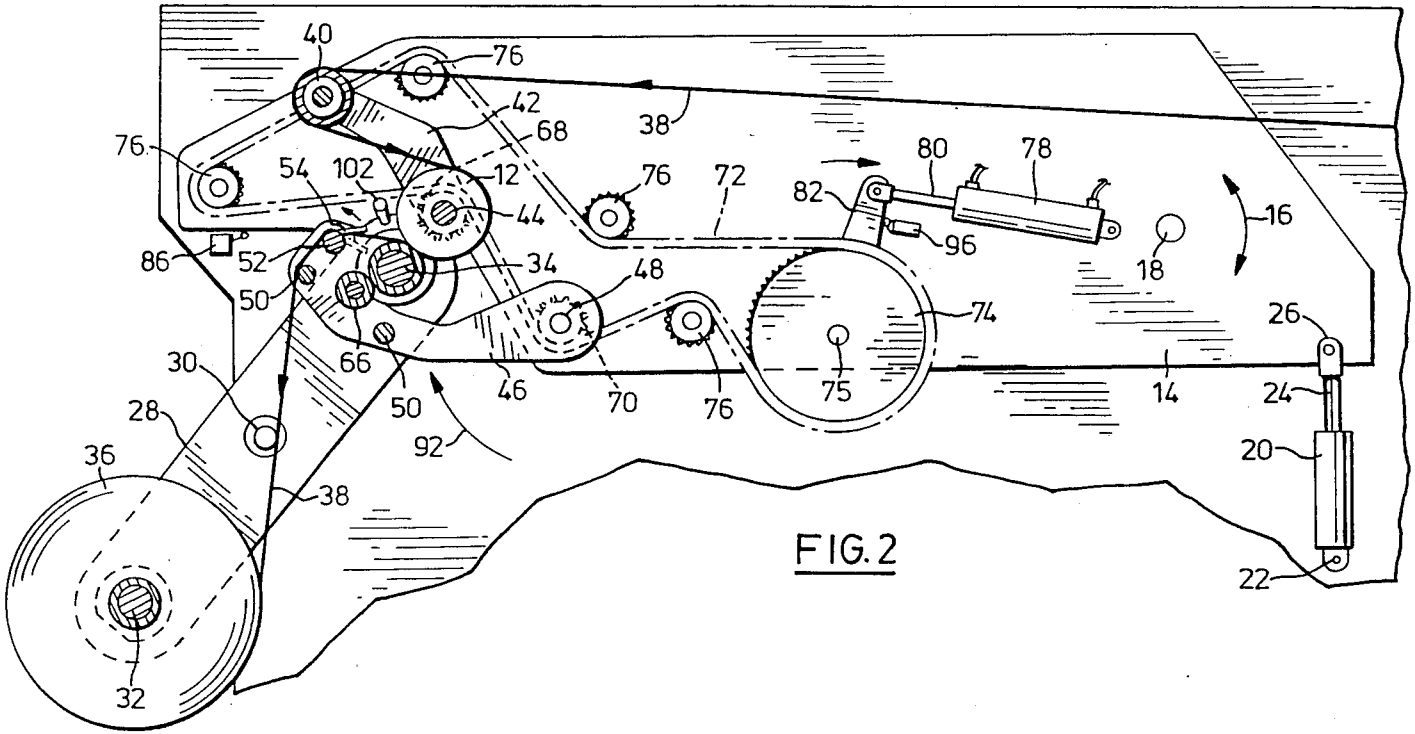
FIG. 2 is a similar view to FIG. 1 showing the cutting assembly in operative cutting position.

The turret winder is illustrated only diagrammatically and consists of two parallel, transversely-spaced, centre-pivoted arms 28 (only one shown) mounted on coaxial stub pivot axles 30 that are rotatably mounted respectively by the two plates 10. Winding mandrels 32 and 34 of any suitable construction are mounted on the arms at opposite ends thereof and, as illustrated in FIGS. 1 and 2, the mandrel 32 has received a full roll 36 of a strip, or web, or flattened tube 38 (hereinafter for convenience in description referred to as the strip 38), while the mandrel 34 is empty and is waiting for the next roll to be wound on it. The mechanism required to drive the mandrels 32 and 34 so as to gather the strip thereon, and to rotate the turret arms 28 when required are not illustrated in that again they are not essential to a full description of the invention and its mode of operation, and will be apparent to those skilled in this particular mechanical art. The strip 38 is received from the collapsing frame of the blown film tower and passes over an auxiliary roll 40 rotatably mounted between the adjacent ends of a pair of arms 42 (only one shown), the other ends of which arms are mounted on a pivot rod 44 that is mounted between the side plates 14 and also carries the strip-engaging lay-on roller 12. The strip then passes during the cutting operation between the roller 12 and the empty mandrel 34 to the storage roll 36.

Figure 3:
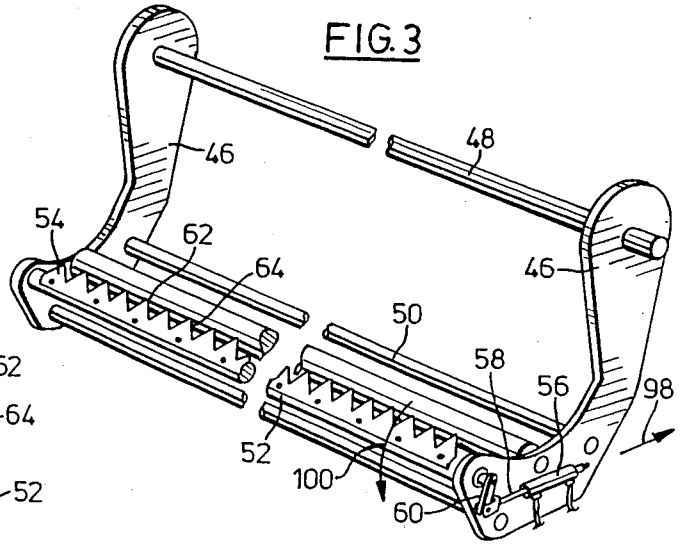
FIG. 3 is an enlarged perspective view of the cutting knife blade and its support structure.
Figure 4:
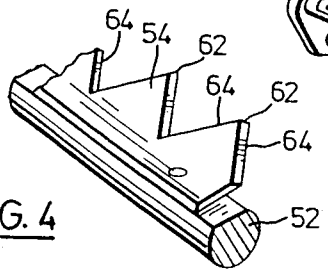
FIG. 4 is a partial perspective view to a still larger scale of part of the knife blade and the knife mounting means.

The cutter assembly comprises two transversely-spaced, parallel arms 46 mounted at adjacent ends on a pivot rod 48 to turn with the rod, the rod being rotatably mounted between the side plates 14, the arms being held rigidly for movement in unison by two connecting cross-members 50. Knife mounting means is constituted by a pivot rod 52 carrying knife blade 54, the rod being mounted between the opposite ends of the arms 46, and being rotated between inoperative and operative attitudes by a pneumatic motor 56 (FIG. 3) mounted on one of the arms 46 and having its piston 58 connected to the pivot rod 52 by a link 60. The knife blade is shown in enlarged detail in FIG. 4, and it will be seen that it has a deeply serrated relieved cutting edge providing a line of sharp, well-defined, piercing points 62 distributed uniformly across the width of the blade, each of which leads progressively to a pair of associated sharp inclined cutting edges 64 that together extend over the full width of the strip. A wrapping roller 66 is mounted for free rotation on a respective axle between the arms 46 in a position thereon such that when the assembly is in the operative cutting position illustrated by FIG. 2 its periphery is pressed firmly against the periphery of the empty mandrel 34.

The various axles, pivot rods and mandrels are of course all mounted with their axes of rotation parallel to one another. The pivot rods 44 and 48 have respective chain sprockets 68 and 70 fastened thereto and are connected for simultaneous rotation by a drive chain 72 that passes around a motor-rotated control sprocket 74, and four idler sprockets 76. The control sprocket 74 is rotated as required on its axle 75 by a pneumatic motor 78 having its piston 80 connected to a link 82 that is fastened to the axle 76.

In operation, the storage roll 36 is filled while its mandrel 32 is in the position in which the mandrel 34 is shown in FIGS. 1 and 2, and during this period the lay-on roller 12 is held clear of the roll by the motor 20, and the cutter assembly is in the inoperative position relative to the frame members 14 shown in FIG. 1 in which it is completely clear of the strip 38.

When the roll is sufficiently full, usually as measured by an automatic counter that counts the number of metres (feet) of strip that have been wound thereon, the turret is operated to move the arms 28 in the direction of the arrow 84 (FIG. 1) until the roll has reached the position shown in FIG. 1, and the empty mandrel 34 has replaced the full mandrel 32. The motor 20 is then operated to rotate the side members 14 anti-clockwise as seen in FIGS. 1 and 2 until the lay-on roller 12 has contacted the mandrel 34, whereupon a limit switch 86 is closed; the operation of this and other electric switches will be described below in conjunction with FIG. 6. At this time the portion of the strip between the roll 36 and the mandrel 34 is straight while under the gentle, steady tension required for tight rolling of the strip. The auxiliary roll 40 is in a position in which the strip 38 has a small excess of travel from a straight path into the nip between the lay-on roll 12 and the mandrel 34. The pneumatic motor 78 is then operated in the direction of arrow 88 to rotate the control sprocket 74 clockwise (arrow 90), thus rotating the cutter arms 46 clockwise (arrow 92) and the auxiliary roll arms 42 anti-clockwise (arrow 94) to the respective positions shown in FIG. 2. In this operative position of the cutter assembly one of the transverse bars 50 and the support rod 52 for the blade engages the strip 38 sufficiently to deflect it out of the straight path between the roll 36 and the mandrel 34, with only a short length thereof, in this embodiment about 5–8 cm (2–3 inches), between the nip of mandrel 34 and roll 12 and the support rod 52, but with the knife blade 54 in the inoperative attitude shown in broken lines in FIG. 2, in which it is clear of the moving strip with its points 62 and cutting edges 64 facing opposite to the direction of strip movement; at the same time the lay-on roller 12 is pressed firmly against the mandrel 34 and the auxiliary roll 40 has moved to a position in which there is now a greater length of strip in the part of the path including the auxiliary roll.

When the arm 82 moves to its full extent in the direction of the arrow 88 it engages a limit switch 96 which operates and, after a time delay set by a time delay relay, as will be described below, causes operation of the pneumatic motor 56. The delay is usually of the order of 2–3 seconds to be sure that the blade assembly is securely in position with the strip deflected, as described above.

The knife motor piston 58 is now operated in the direction of arrow 98 (FIG. 3), rotating the knife support bar 52 anti-clockwise (arrow 100), in this embodiment through an angle of about 30 degrees, so that the knife blade points 62 engage the very short length of the moving strip between the mandrel and the bar 54, this length being so short relative to the travel of the knife that it is impossible for the strip to avoid the points. The movement of the strip against the knife points immediately forces the strip into engagement with them and also positively assists the rotation of the blade in the direction of arrow 100 to force the strip and the blade into engagement with one another. The blade continues its rotation to the position shown in solid lines in FIG. 2, in which the strip has been fully penetrated and cut. Thus, as soon as even one point has engaged the strip, the strip and the blade are positively forced further together by the strip movement with no possibility of the strip being able to retreat from the knife, despite the considerable elasticity of the strip material. After a period of time set by a timing relay, as described in more detail below, the knife is returned to its inoperative attitude and the cutting assembly is returned to its inoperative position.

Since the portion of the strip engaged by the knife is under tension, as soon as this is relieved by the cutting of the strip the resulting cut leading edge will tend to move down toward the periphery of the upper mandrel 34. Moreover, at the same time a blast of air is directed against the free edge of the strip by a plurality of transversely-spaced air nozzles 102. The strip edge is therefore blown against the mandrel and trapped between the mandrel, the wrapper roller 66, and thereafter the lay-on roller 12 and winding of the new roll begins on the mandrel 34. At this time the pneumatic motor 66 is reversed, so that the slack strip that was produced by the auxiliary roller 40 is now available for wrapping rapidly around the mandrel to start the new storage roll. This wrapping action is assisted, if required, by use of a mandrel of the type which is hollow in its centre with bores extending from the hollow centre to the periphery, a vacuum being drawn in the centre to suck the strip against the mouths of the bores and thus against the mandrel periphery. The full roll 36 is now removed and a new empty mandrel put in place for the entire operation to be repeated as soon as the new roll is sufficiently full.

Figure 6:
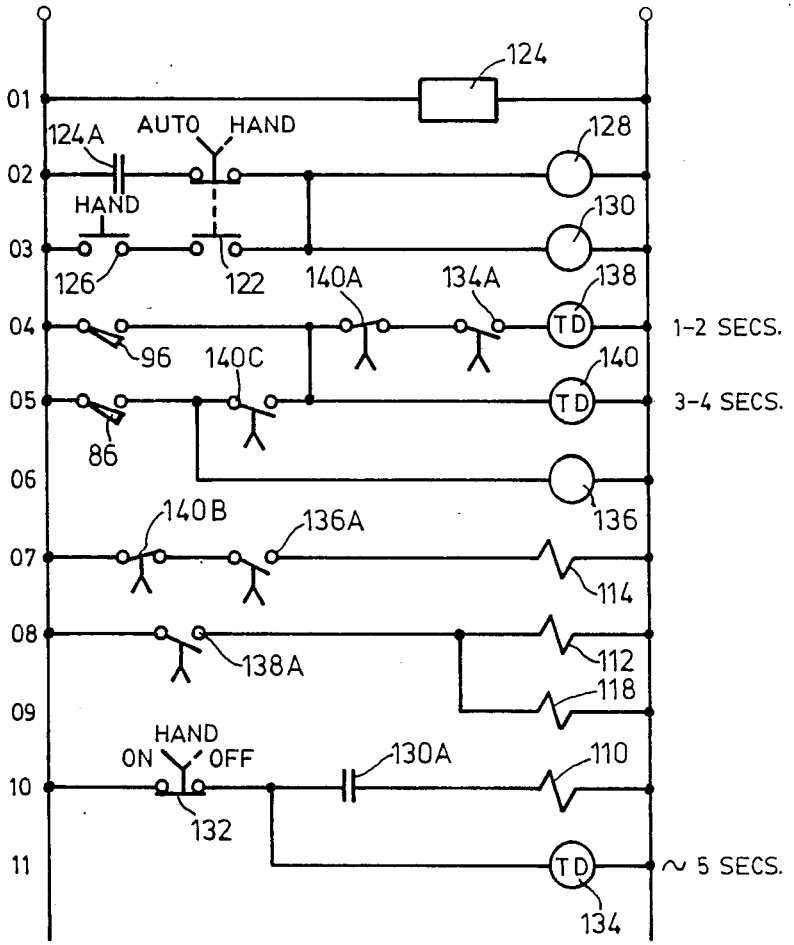
FIG. 6 is a schematic diagram of the part of the electrical circuit for controlling operation of the cutting assembly.

Referring to FIG. 6, air for the motors 20, 56 and 78 is supplied under pressure from a source (not shown) via a valve 104, a regulator/filter/lubricator unit 106 and individual regulators 108 to the respective solenoid-operated air valves 110, 112 and 114. The exhausted air exits through a muffler 116. The operation of the various other check valves, throttles, etc. that are required for such a system will be apparent to those skilled in the art and do not require specific description. Air for the nozzles 102 is supplied from a separate source to its respective solenoid-operated air valve 118, the line to this valve including a reservoir 120 to accommodate a volume of air for the necessary quick blast.

Figure 5:
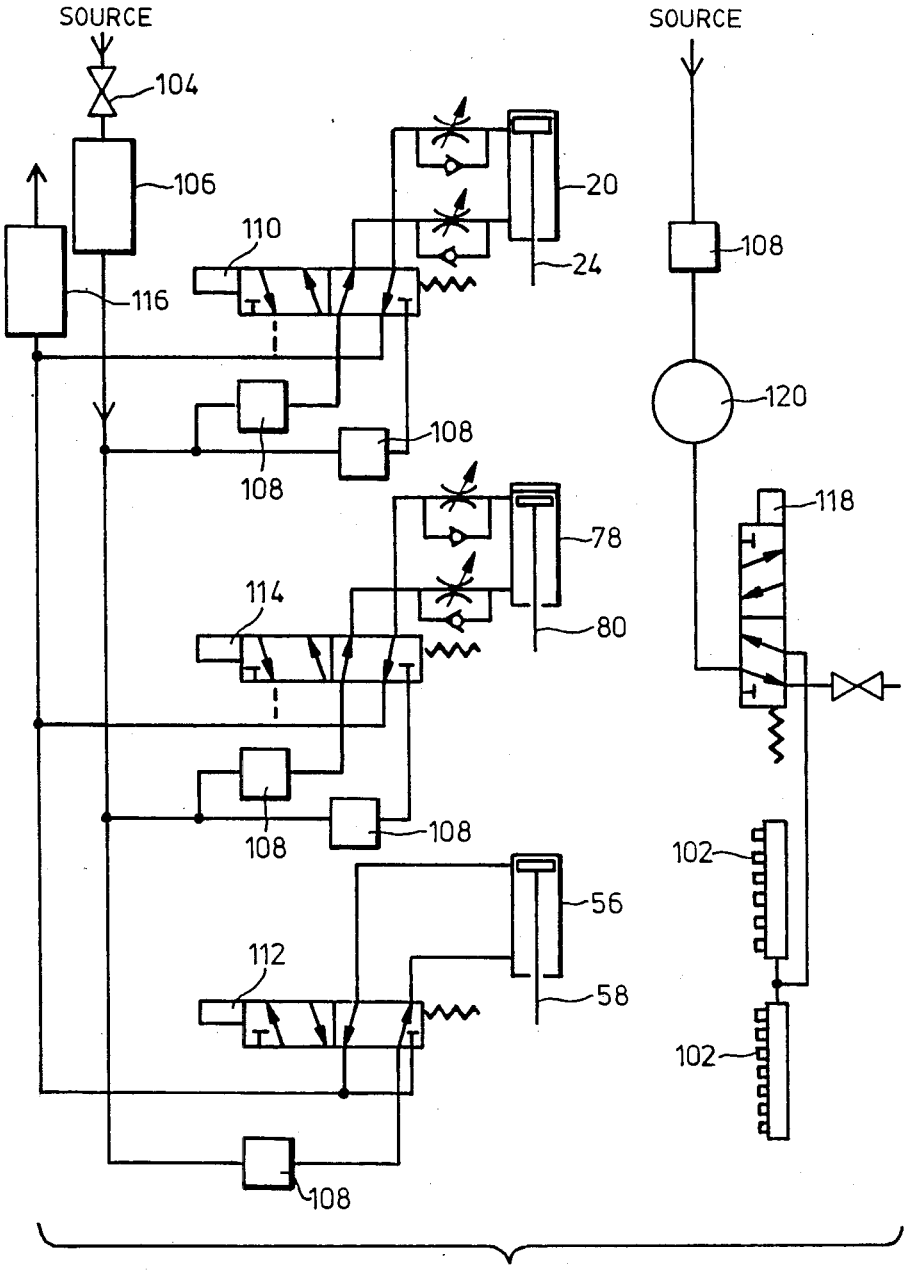
FIG. 5 is a schematic diagram of the part of the pneumatic control circuit for controlling operation of the cutting assembly.

As FIG. 5 shows only the essential pneumatic elements required to fully describe the operation of the invention, so FIG. 6 shows only the essential electric elements for that purpose. Switch 122 (line 02) sets the cutter assembly either for automatic control from counter 124 (01) when it measures the required length of strip, or from hand switch 126 (03) if the operator wishes to initiate an operation. Thus, the counter closes its normally open (NO) contacts 124A (02), or the switch 126 is closed manually, whereupon the two control relays 128 (02) and 130 (03) are energized. Control relay 128 initiates the sequence that moves the full roll 36 to the lower position, which will not be further described, while control relay 130 closes its contacts 130A (10) and, provided hand control switch 132 (10) is closed, solenoid 110 (10) of the respective air valve is energized and lay-on roller motor 20 is operated. The switch 132 enables this operation to be initiated by the operator. At the same time time delay relay 134 (11) is energized closing its NO contacts 134A (04) after a predetermined period.

When the lay-on roll 12 is in position, limit switch 86 (05) is closed, energizing time delay relay 136 which closes its contacts 136A (07), so that after a predetermined period to ensure that the lay-on roll is in position the solenoid 114 of that relay is energized to operate the motor 78 and swing the cutter assembly into position. With the cutter assembly in position, the limit switch 96 (04) is closed energizing time delay relay 138 (04), provided that the time delay contacts 134A are closed. With contacts 138A closed, the solenoids 112 and 118 of the respective air valves are energized to operate the knife and initiate the air blast from the nozzles 102. The closing of limit switch 96 also energized a time delay relay 140 (05) having normally closed contacts 140A (04) and 140B (07) and normally open latching contacts 140C (05). The difference in time delays of the relays 138 (1–2 seconds) and 140 (3–4 seconds) sets the period for which the knife blade is in its operative attitude (usually 1–2 seconds), the opening of contacts 140A disabling the relay 138 whereupon contacts 138A (08) open to disable the knife motor relay 112 and its motor 56, and to stop the air blast via relay 118, while the opening of the contacts 140B disables the arm moving valve 114 and its motor 78 to return the cutting assembly to the inoperative position of FIG. 1. The sequence can then repeat. The delay provided by time delay relay 134 is longer than that provided by the relays 138 and 140, so that these relays have finished operating before the hand operation by switch 132 to lay-on the roller 12 takes effect, whereby the cutting assembly is not operated when the switch 132 is closed by the operator.

Although the invention has been described in connection with a cutting assembly applied to a turret-type winder, it will be apparent that it is also applicable to any type of strip-handling apparatus in which the strip path is such as to permit the knife assembly the necessary access to the strip where it can be immediately adjacent to the strip and apply the knife blade to the strip with its strip-engaging points facing in the direction opposite to that of the strip movement. The assembly will be operative if sufficiently close to the strip, but it is preferred to operate it as described in which the strip is deflected out of its path, since even more positive operation is thereby obtained.

Figure 7:
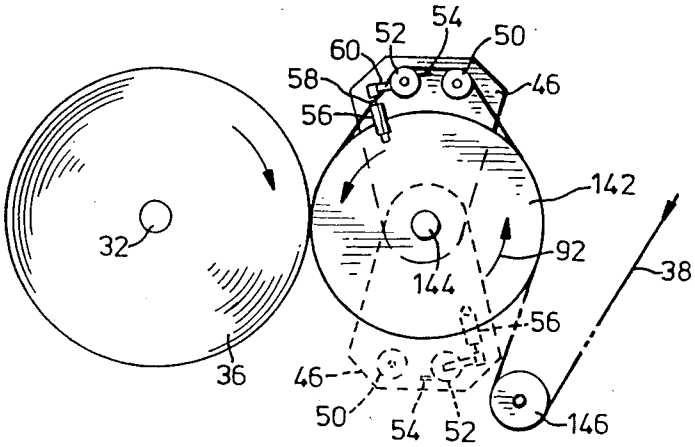
FIG. 7 is a side elevational view of a surface winder employing a cutting assembly of the invention.

Another application of the invention is shown in FIG. 7, in which the same reference numbers are used where possible, the apparatus being a surface winder employing a relatively large diameter winding drum 142 mounted for rotation on an axle 144, the strip 38 passing over the top circumference of the drum from a spreader roll 146. The cutter assembly arms 46 are also mounted for pivoting movement on the axle 144 from the stored inoperative lower position shown in broken lines to the operative position shown in solid lines. It will be seen that as the assembly moves in the direction of the arrow 92 the knife support bar 52 and the cross-member 50 engage the strip, so that at the uppermost position the short section of the strip between the members 50 and 52 is under tension and ready for engagement by the knife blade 54.

It will be noted that with the cutting assembly of the invention the knife is virtually stationary, and it is essentially the movement of the strip that produces the cutting. Moreover, the knife is beneath the strip as far as the operator is concerned, and it is inherently much safer than a knife which moves transversely of the strip to cut it.

I claim:

1. A cutting assembly for strip-handling apparatus in which a thin, flexible strip of material to be cut by the assembly moves in a strip path of the apparatus in a corresponding direction of movement, comprising:

an apparatus frame;

an elongated knife blade of length at least the width of the strip and having distributed along its length a plurality of strip engaging and piercing knife points in advance of succeeding strip severing knife edges;

knife mounting means mounting the knife blade to extend transversely of the strip direction of movement with the said knife points pointing in the direction opposite to the direction of movement of the strip, and also for movement of the knife blade between an inoperative attitude in which the knife points and edges are clear of the strip and an operative attitude in which the knife points and edges engage the strip;

support means mounting the knife mounting means in the apparatus frame for movement between an inoperative position in which the knife mounting means and the knife are clear of the strip, and an operative position in which the knife mounting means is adjacent to a portion of the strip, without engagement of the knife points and edges with the strip;

motor means connected between the apparatus frame and the support means and operative to move the support means for said movement between the inoperative and operative positions; and motor means mounted between the support means and the knife mounting means and operative to move the blade between the said inoperative and operative attitudes, in the operative attitude the knife points engaging the adjacent portion of the strip, whereby the movement of the strip positively engages the strip with the knife points and thereafter with the knife edges to sever the strip across its width.

2. A cutting assembly as claimed in claim 1, wherein in the said operative position the support means engages the strip to displace the said adjacent portion of the strip from its path.

3. A cutting assembly as claimed in claim 2, wherein the support means engages the strip closely adjacent to a roll member over which the strip passes, so that the said adjacent portion of the strip that is engaged by the knife points and blades is between the support means and the said roll member.

4. A cutting assembly as claimed in claim 2, wherein knife mounting means engages the strip to displace the said adjacent portion from its path.

5. A cutting assembly as claimed in claim 4, wherein the said support means also mounts a transverse cross-member extending parallel to and spaced from the knife mounting means, the cross-member also contacting the strip when the support means has moved to engage and displace the said adjacent portion of the strip, the said adjacent portion extending between the knife mounting means and the support means.

6. A cutting assembly as claimed in claim 2, wherein the said support means also mounts a transverse cross-member extending parallel to and spaced from the knife mounting means, the cross-member also contacting the strip when the support means has moved to engage and displace the said adjacent portion of the strip.

7. A cutting assembly as claimed in claim 1, wherein the said knife blade has a serrated cutting edge comprising a plurality of uniformly transversely-spaced piercing knife points, each leading to two respective succeeding severing knife edges.

8. A cutting assembly as claimed in claim 1, wherein the said support means comprises a pair of parallel, transversely-spaced arms between which the knife mounting means and the knife blade extends transverse to the direction of movement of the strip.

* * * * *